US005509721A

United States Patent [19]

Huang

[11] Patent Number: 5,509,721

[45] Date of Patent: Apr. 23, 1996

[54] FOLDABLE RECLINER STRUCTURE FOR AN INFANT

[76] Inventor: Li-Chu C. Huang, No. 9, Alley 2, Lane 606, Sec. 2, Po Ai Rd., Chia Yi City, Taiwan

[21] Appl. No.: 331,365

[22] Filed: Oct. 27, 1994

[51] Int. Cl.[6] ..... A47D 1/02

[52] U.S. Cl. ..... 297/452.13; 297/51; 297/188.1; 297/DIG. 11

[58] Field of Search ..... 297/51, 188.1, 297/440.1, 440.11, 445, 452.73, 452.10, 452.20, DIG. 11

[56] References Cited

U.S. PATENT DOCUMENTS 4,553,786 11/1985 Lockett, III et al. ..... 297/452.13 X
5,207,478 5/1993 Freese et al. ..... 297/452.13 X
5,269,591 12/1993 Muga, Jr. et al. ..... 297/452.13
5,308,143 5/1994 Cheng et al. ..... 297/DIG. 11 X
5,411,315 5/1995 Greenwood ..... 297/DIG. 11 X

*Primary Examiner*—Peter R. Brown
*Attorney, Agent, or Firm*—Welsh & Katz, Ltd.

[57] ABSTRACT

A foldable recliner frame for an infant includes a pair of spaced fixed seats, a horizontal beam securely mounted between the fixed seats, a substantially U-shaped seat supporting member having two distal ends thereof pivotally mounted to upper ends of the fixed seats, a substantially U-shaped backrest supporting member having two distal ends thereof pivotally mounted to the upper ends of the fixed seats, and a substantially U-shaped base frame member having two distal ends thereof pivotally mounted to lower ends of the fixed seats. The fixed seats further have two mutually faced ledges respectively formed thereon to provide a support for the seat supporting member when the recliner frame is in an extended position.

4 Claims, 5 Drawing Sheets

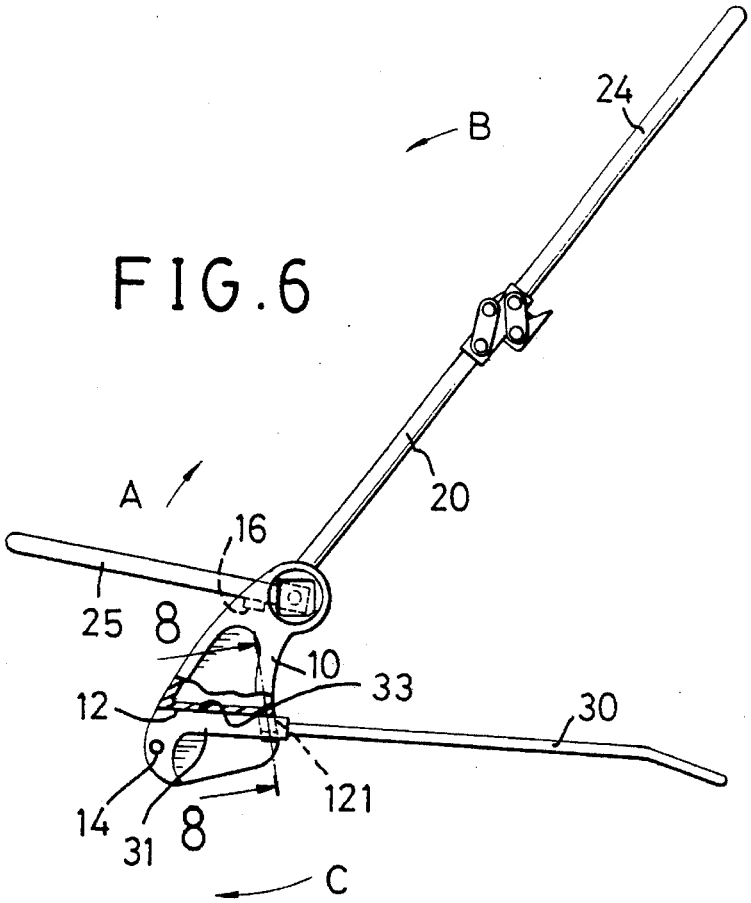
FIG.6
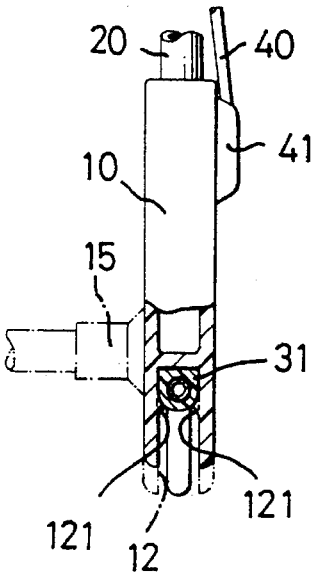
FIG.8
FIG.7
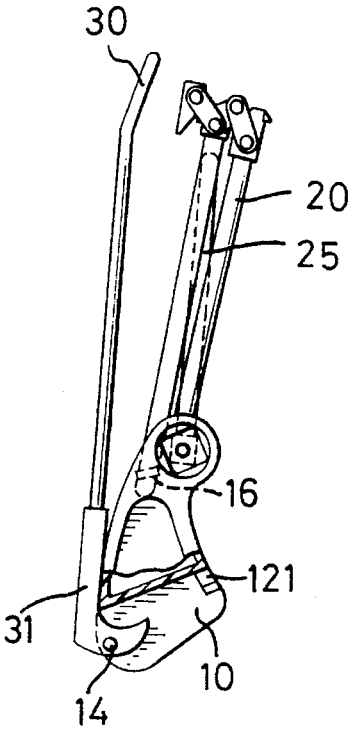

FOLDABLE RECLINER STRUCTURE FOR AN INFANT

BACKGROUND OF THE INVENTION

1. Field of the Invention

The present invention relates to a foldable recliner for an infant.

2. Description of Related Art

A typical recliner for an infant generally includes an integrally formed seat/back frame member, a base frame member which is integral with and is at an angle to the seat/back frame member, and a cushion mounted on the seat/back frame member on which an infant may lie. The conventional recliner structure has several drawbacks. Firstly, for manufacturers, the structure is bulky as the base frame member and the seat/back frame member are fixed and thus occupy a considerable storage space for semi-products. Furthermore, the final products also occupy considerable space as being not foldable which results in an increase in the transportation cost and which also causes inconvenience for users when considering storage and carrying.

Therefore, there has been a long and unfulfilled need for a foldable recliner structure to mitigate and/or obviate the above-mentioned drawbacks.

SUMMARY OF THE INVENTION

It is an object of the present invention to provide a foldable recliner frame for an infant which includes a pair of spaced fixed seats, a horizontal beam securely mounted between the fixed seats, a substantially U-shaped seat supporting member having two distal ends thereof pivotally mounted to upper ends of the fixed seats, a substantially U-shaped backrest supporting member having two distal ends thereof pivotally mounted to the upper ends of the fixed seats, and a substantially U-shaped base frame member having two distal ends thereof pivotally mounted to lower ends of the fixed seats. Preferably, the fixed seats further have two mutually faced ledges respectively formed thereon to provide a support for the seat supporting member when the recliner frame is in an extended position.

In accordance with one aspect of the invention, a groove is defined in the lower end of each fixed seat, a pair of protrusions being respectively formed on two mutually faced walls which together define the groove. Correspondingly, the base frame member includes two hooked ends each of which is pivotally mounted in the associated groove, the hook ends of the base frame member being retained in position by the protrusions when the recliner frame is in an extended position.

In accordance with another aspect of the invention, the backrest supporting member includes two first sections each having a first end securely attached to the associated fixed seat and a second end, a substantially U-shaped second section having two distal ends, and two toggle means for respectively mounting the distal ends of the second section to the second ends of the first sections. Each toggle means includes a first toggle member having a first end securely mounted to the second end of the associated first section, a pair of spaced ears attached to the first toggle member at a location adjacent to the first end, and a second end having a catch member formed thereon. Each toggle means further includes a second toggle member having a first end securely mounted to the associated distal end of the second section, a second end pivotally connected to the ears of the associated first toggle member, and a spring-biased clip member for releasably engaging with the catch member on the associated first toggle member.

Other objects, advantages, and novel features of the invention will become more apparent from the following detailed description when taken in conjunction with the accompanying drawings.

BRIEF DESCRIPTION OF THE DRAWINGS

FIGS. 6 and 7 are partially sectioned side views illustrating folding of the recliner; and FIG. 8 is a schematic partially sectioned rear view taken along line 8—8 in FIG. 6.

DESCRIPTION OF THE PREFERRED EMBODIMENT

Figure 1:
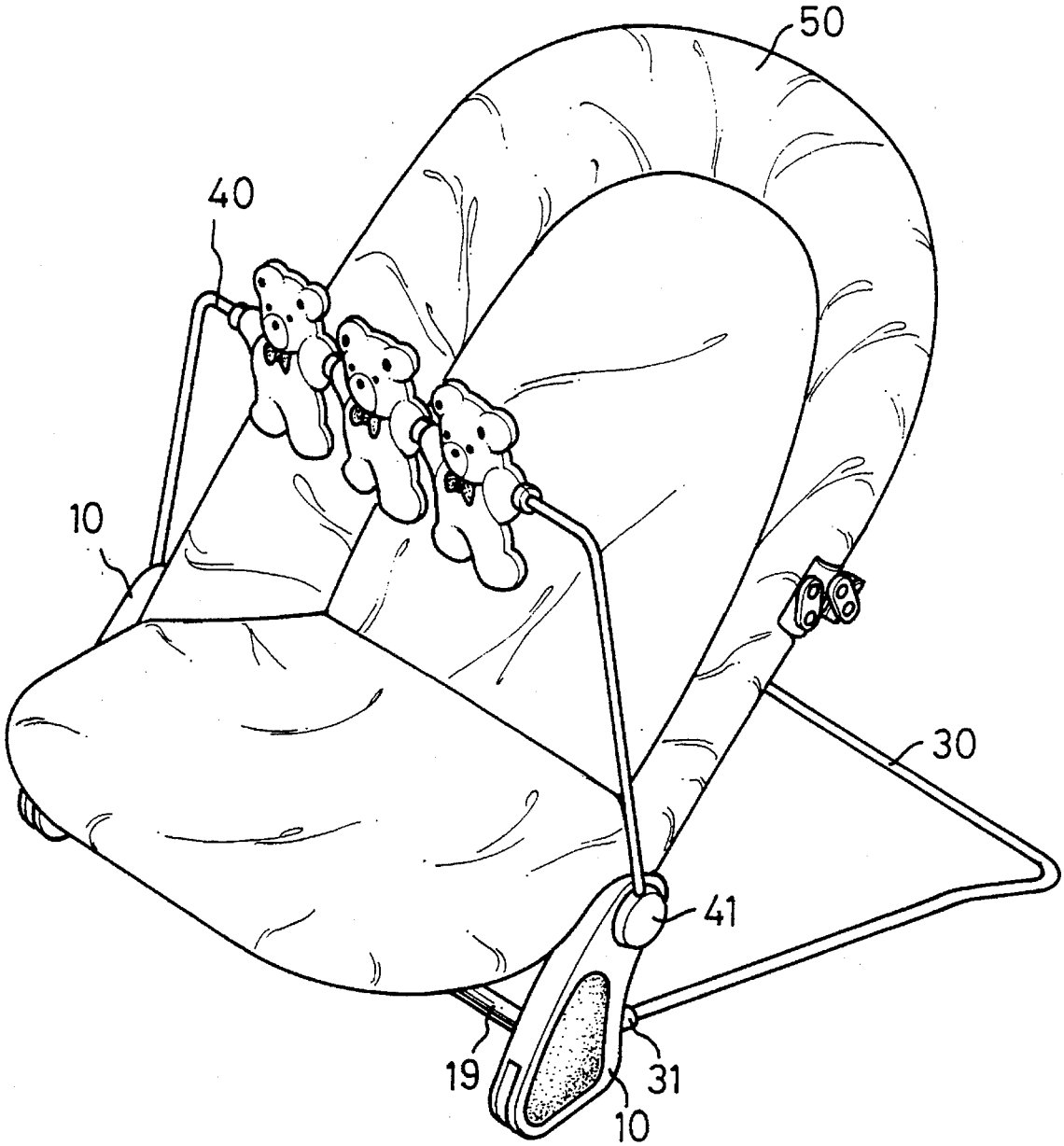
FIG. 1 is a perspective view of a foldable recliner in accordance with the present invention.
Figure 2:
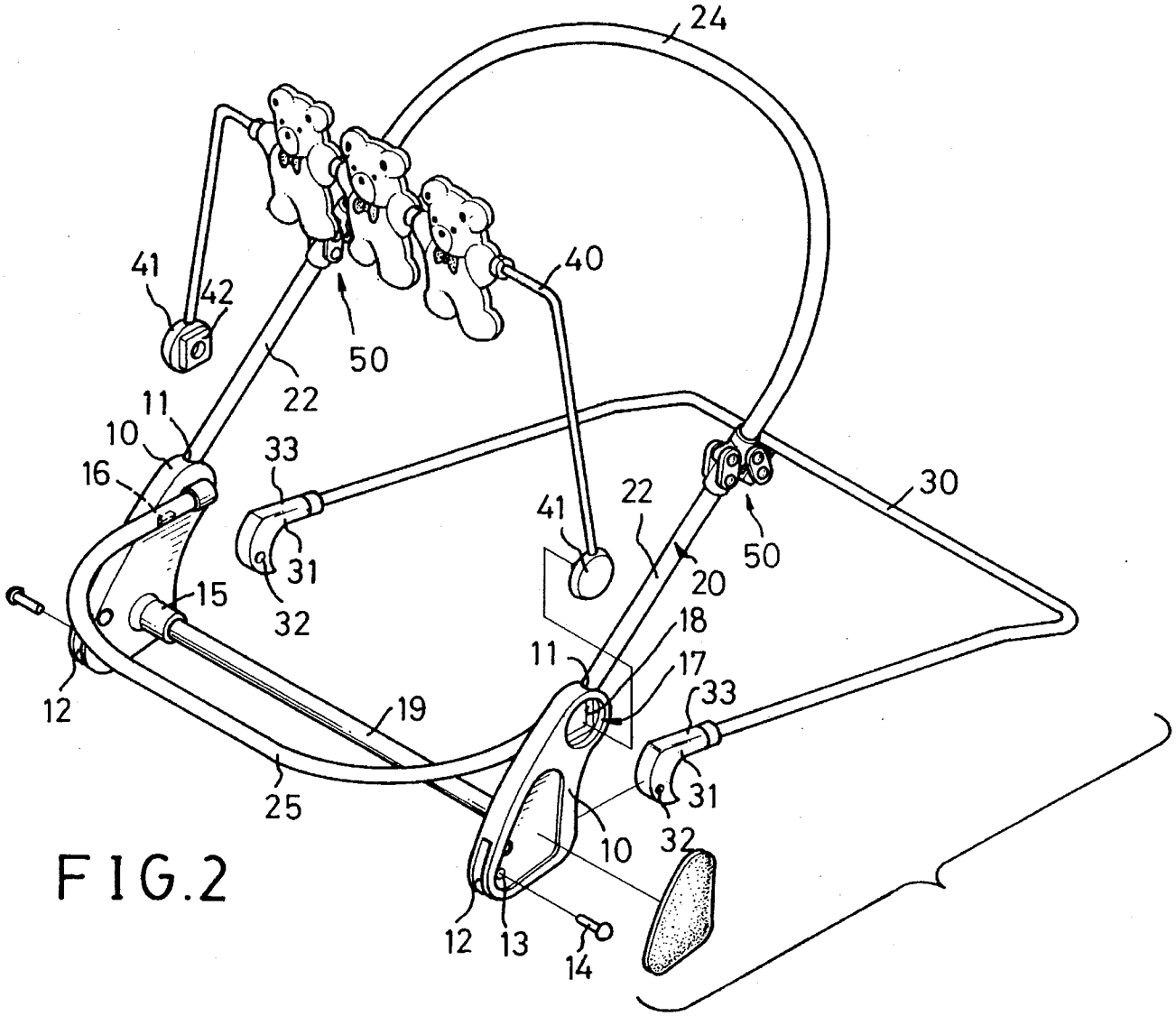
FIG. 2 is an exploded view of the foldable recliner in which the mat thereof is omitted for clarity.

Referring to the drawings and initially to FIGS. 1 and 2, a foldable recliner frame for an infant in accordance with the present invention generally includes a pair of spaced fixed seats 10, a horizontal beam 19 securely mounted between the fixed seats 10, a substantially U-shaped seat supporting member 25 having two distal ends thereof pivotally mounted to upper ends of the fixed seats 10, a, substantially U-shaped backrest supporting member 20 having two distal ends thereof pivotally mounted to the upper ends of the fixed seats 10, and a substantially U-shaped base frame member 30 having two distal ends thereof pivotally mounted to lower ends of the fixed seats 10. The recliner frame generally has a soft cushion 50 mounted to the seat supporting member 25 and backrest supporting member 20 for comfortably supporting an infant.

Each fixed seat 10 has a hole 11 in the upper end thereof for securely receiving an associated end of the backrest supporting member 20, and a groove 12 defined in a lower end thereof, a pair of protrusions 121 (see FIG. 8) being respectively formed on two mutually faced walls which together define the groove 12. The base frame member 30 is preferably made of an elastic steel bar and includes two hooked ends 31 each having a pivotal hole 32 transversely defined therein and an upper end 33 fromed on an upper end thereof.

Each fixed seat 10 has a boss 15 on one side thereof and two ends of the horizontal beam 19 are removably mounted to the bosses 15 which are arranged to face each other. To provide a support for the seat supporting member 25, the fixed seats 10 further have two mutually faced ledges 16 respectively formed thereon.

Figure 3:
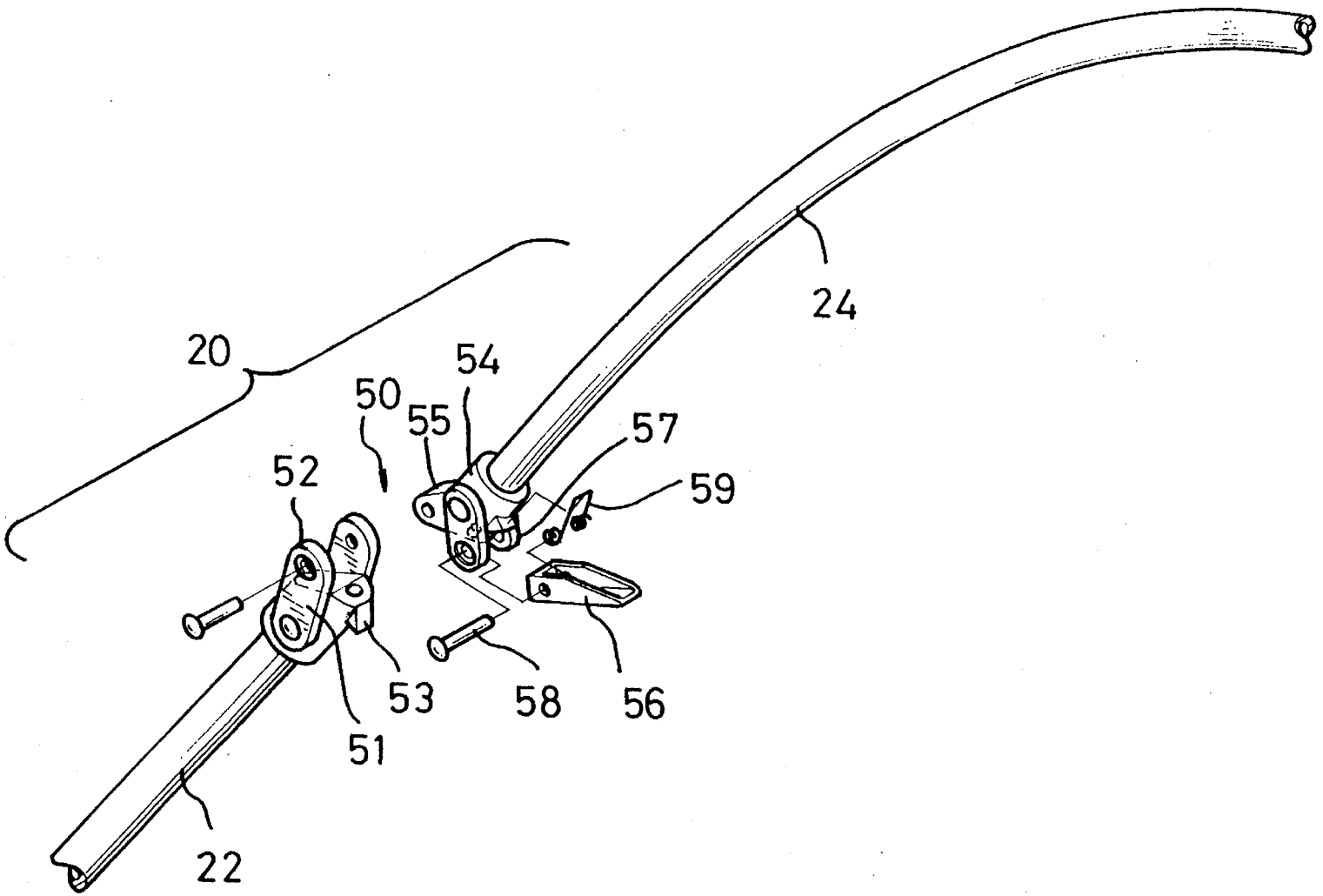
FIG. 3 is a partial exploded view illustrating the backrest supporting member.
Figure 4:
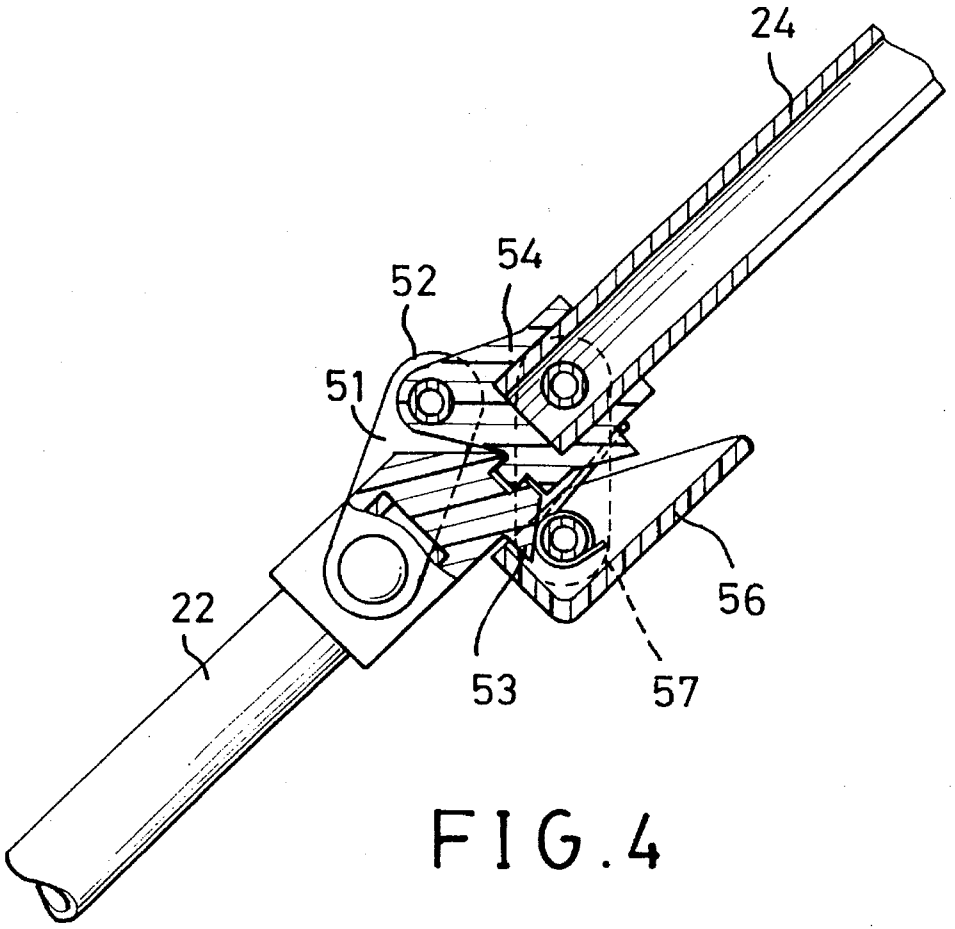

Still referring to FIG. 2 and further to FIGS. 3 and 4, the backrest supporting member 20 includes two first sections 22 each having a first end securely received in the hole 11 of the associated fixed seat 10 and a second end and a U-shaped second section 24 having two distal ends thereof respectively connected to the second ends of the first sections 22 via two toggle means 50.

Figure 5:
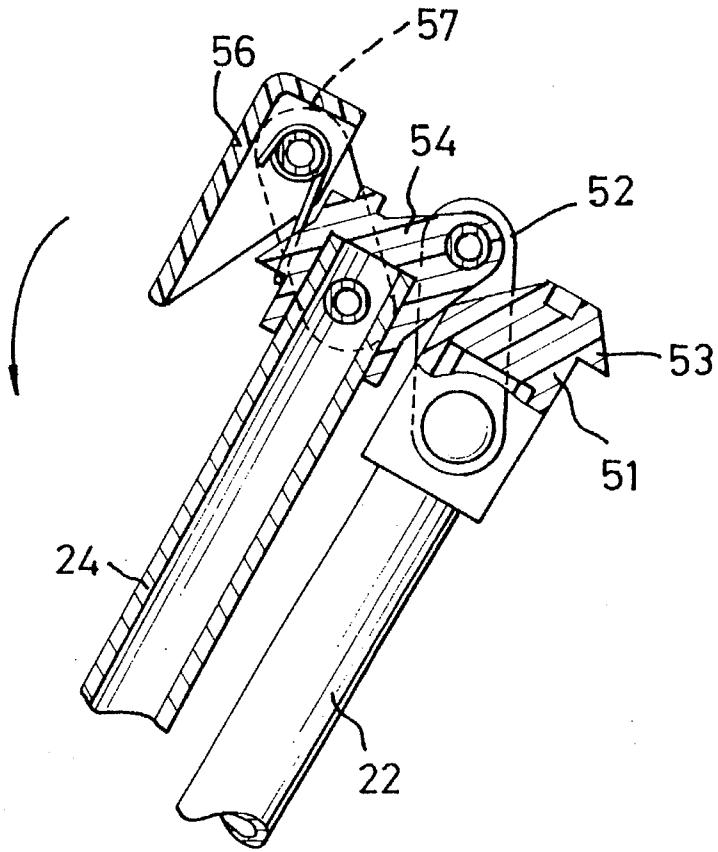
FIGS. 4 and 5 are partially sectioned side views illustrating folding of the backrest supporting member.

As shown in FIG. 3, each toggle means 50 includes a first toggle member 51 having a first end securely mounted to the second end of the associated first section 22, a pair of spaced ears 52 attached to the first toggle member 51 at a location adjacent to the first end, and a second end having a catch member 53 formed thereon. Each toggle means 50 further includes a second toggle member 54 having a first end securely mounted to an associated end of the second section 24, a second end 55 pivotally connected to the ears 52 of the associated first toggle member 51, a spring-biased clip member 56 for releasably engaging with the catch member 53 on the associated first toggle member 51. As can be seen in FIG. 3, the clip member 56 is mounted to two second spaced ears 57 formed on the second toggle member 54 by a pin 58 and is biased by a spring 59. By such arrangement, the second section 24 is foldable with respect to the first sections 22 by pressing the clip members 57 to disengage with the catch members 53 which allows pivotal movement of the second toggle members 54 with respect to the first toggle members 51, as illustrated in FIGS. 4 and 5.

Preferably, each fixed seat 10 may have a circular recess 17 (see FIG. 2) in the upper end thereof which has a rectangular or polygonal recess 18 therein. A substantially U-shaped toy mounting element 40 has two ends each having a disc-like element 41 with a rectangular or polygonal block 42 thereon for removably engaging with associated recesses 17 and 18.

In assembly, the fixed seats 10 are interconnected by inserting the horizontal beam 19 into the bosses 15. Then, two ends of the seat supporting member 25 are pivotally attached to upper ends of the mutually-facing sides of the fixed seats 10, and the seat supporting member 25 may rest on the ledges 16. Thereafter, the backrest supporting member 20 is securely mounted to the upper ends of the fixed seats 10 as described hereinbefore. Then, the two ends 31 of the base frame member 30 are respectively pivotally mounted in the recesses 12 in the lower ends of the fixed seats 10 by means of pins 14 passing through pin holes 13 each defined transversely through the respective fixed seats 10. The toy mounting element 40 may be optionally mounted to upper ends of the fixed seats 10 as described hereinbefore. The assembled recliner structure is shown in FIG. 6 and in which status an upper end 33 of each hooked end 31 of the base frame member 30 is retained in position by the protrusions 121 (see FIG. 8).

To fold the recliner structure, the toy mounting element 40, if mounted, is firstly detached from the fixed seats 10. Then, the recliner structure is lifted and the seat supporting member 25 is rotated toward the backrest supporting member 20 (see arrow A) until member 25 contacts with the bosses 15. Thereafter, the second section 24 of the backrest supporting member 20 is folded (see arrow B) to be in a status parallel to the first sections 22 as described hereinbefore. Finally, the base frame member 30, after disengaging with the protrusions 121, is rotated in a direction indicated by arrow C to a folded status shown in FIG. 7. Unfolding of the recliner structure can be easily accomplished by reversing the above steps.

According to the above description, it is appreciated that the invention provides a foldable recliner structure which is convenient in storage, carrying, and transportation for users and manufacturers.

Although the invention has been explained in relation to its preferred embodiment, it is to be understood that many other possible modifications and variations can be made without departing from the spirit and scope of the invention as hereinafter claimed.

I claim:

1. A foldable recliner frame for an infant comprising:

a pair of spaced fixed seats each having upper and lower ends;

a horizontal beam securely mounted between said fixed seats;

a substantially U-shaped seat supporting member having two distal ends thereof pivotally mounted to said upper ends of said fixed seats;

a substantially U-shaped backrest supporting member having two distal ends thereof pivotally mounted to said upper ends of said fixed seats; and a substantially U-shaped base frame member having two distal ends thereof pivotally mounted to said lower ends of said fixed seats;

said fixed seats further having two mutually faced ledges respectively formed thereon to provide a support for said seat supporting member when said recliner frame is in an extended position, and a groove defined in said lower end of each said fixed seats, a pair of protrusions being respectively formed on two mutually faced walls which together define said groove, said base frame member including two hooked ends each of which is pivotally mounted in associated said groove, and said hook ends of said base frame member being retained in position by said protrusions when said recliner frame is in an extended position.

2. The foldable recliner frame as claimed in claim 1 wherein:

said backrest supporting member includes two first sections each having a first end securely attached to associated said fixed seat and a second end, a substantially U-shaped second section having two distal ends, and two toggle means for respectively mounting said distal ends of said second section to said second ends of said first sections;

each said toggle means includes:

a first toggle member having a first end securely mounted to said second end of an associated said first section, a pair of spaced ears attached to said first toggle member at a location adjacent to said first end, and a second end having a catch member formed thereon; and a second toggle member having a first end securely mounted to an associated said distal end of said second section, a second end pivotally connected to said ears of an associated said first toggle member, and a spring-biased clip member for releasably engaging with said catch member on said associated first toggle member.

3. The foldable recliner frame as claimed in claim 2 wherein:

each said second toggle member has two spaced second ears.

4. A foldable recliner frame for an infant comprising:

a pair of spaced fixed seats each having upper and lower ends;

a horizontal beam securely mounted between said fixed seats;

a substantially U-shaped seat supporting member having two distal ends thereof pivotally mounted to said upper ends of said fixed seats;

a substantially U-shaped backrest supporting member having two distal ends thereof pivotally mounted to said upper ends of said fixed seats; and a substantially U-shaped base frame member having two distal ends thereof pivotally mounted to said lower ends of said fixed seats;

said fixed seats further having two mutually faced ledges respectively formed thereon to provide a support for said seat supporting member when said recliner frame is in an extended position, said upper end of each said fixed seat has a circular recess with a polygonal recess therein, a substantially U-shaped toy mounting element with two ends each having a disc-like element with a block thereon for fittingly yet removably engaging with the recess.

* * * * *